US010603919B2

(12) United States Patent
Horade

(10) Patent No.: US 10,603,919 B2
(45) Date of Patent: Mar. 31, 2020

(54) LIQUID DISCHARGE DEVICE

(71) Applicant: BROTHER KOGYO KABUSHIKI KAISHA, Nagoya-shi, Aichi-ken (JP)

(72) Inventor: Kenta Horade, Toukai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/156,078

(22) Filed: Oct. 10, 2018

(65) Prior Publication Data

US 2019/0105913 A1 Apr. 11, 2019

(30) Foreign Application Priority Data

Oct. 10, 2017 (JP) ..... 2017-197167

(51) Int. Cl.
*B41J 2/175* (2006.01)
*B41J 29/38* (2006.01)
*B41J 29/13* (2006.01)

(52) U.S. Cl.
CPC ..... *B41J 2/17566* (2013.01); *B41J 2/1752* (2013.01); *B41J 2/17509* (2013.01); *B41J 2/17513* (2013.01); *B41J 2/17523* (2013.01); *B41J 2/17546* (2013.01); *B41J 2/17553* (2013.01); *B41J 29/13* (2013.01); *B41J 29/38* (2013.01); *B41J 2002/17573* (2013.01); *B41J 2002/17576* (2013.01)

(58) Field of Classification Search
CPC .... B41J 2/175; B41J 2/17503; B41J 2/17506; B41J 2/17509; B41J 2/17513; B41J 2/1752; B41J 2/17523; B41J 2/17553; B41J 2/17566; B41J 2002/1756
See application file for complete search history.

(56) References Cited

U.S. PATENT DOCUMENTS

2008/0204488 A1* 8/2008 Usui ..... B41J 2/17513 347/7
2008/0231676 A1* 9/2008 Shimizu ..... B41J 2/17513 347/86
2016/0059570 A1* 3/2016 Kobayashi ..... B41J 2/17523 347/86
2016/0059571 A1* 3/2016 Kobayashi ..... B41J 2/17513 347/7

FOREIGN PATENT DOCUMENTS

JP 2008-213162 A 9/2008

* cited by examiner

*Primary Examiner* — Scott A Richmond
(74) *Attorney, Agent, or Firm* — Merchant & Gould P.C.

(57) ABSTRACT

A liquid discharge device includes a case receiving a cartridge having a first liquid chamber, a tank having a second liquid chamber, a head, a liquid level sensor and a controller configured to: based on receiving, from the liquid level sensor, a second signal after receiving a first signal, determine a total liquid amount Vt as a fixed value A; receive a second discharge instruction; update a second count value with a value equivalent to an amount of the liquid instructed to be discharged by the second discharge instruction; subtract the second count value from the total liquid amount Vt determined as the fixed value A to calculate the total liquid amount Vt; and determine the liquid amounts Vc and Vs based on the obtained total liquid amount Vt.

13 Claims, 10 Drawing Sheets

LIQUID DISCHARGE DEVICE

CROSS-REFERENCE TO RELATED APPLICATION

This application claims priority from Japanese Patent Application No. 2017-197167 filed on Oct. 10, 2017, the entire subject-matter of which is incorporated herein by reference.

TECHNICAL FIELD

The disclosure relates to a liquid discharge device for discharging a liquid.

BACKGROUND

There has been known an inkjet printer including a detachable main tank, a sub tank that stores ink supplied from the installed main tank, and an image recording unit that discharges the ink stored in the sub tank and records an image. Internal spaces of the main tank and the sub tank are opened to the air. For this reason, when the main tank is installed in the inkjet printer, the ink moves due to a water head pressure so that the liquid level of the main tank and the liquid level of the sub tank are aligned with the same height by the difference between a water head in the internal space of the main tank and a water head in the internal space of the sub tank (hereinafter, referred to as "water head difference").

SUMMARY

A liquid discharge device includes a case receiving a cartridge having a first liquid chamber, a tank having a second liquid chamber, a head, a liquid level sensor and a controller configured to: based on receiving, from the liquid level sensor, a second signal after receiving a first signal, determine a total liquid amount Vt as a fixed value A; receive a second discharge instruction; update a second count value with a value equivalent to an amount of the liquid instructed to be discharged by the second discharge instruction; subtract the second count value from the total liquid amount Vt determined as the fixed value A to calculate the total liquid amount Vt; and determine the liquid amounts Vc and Vs based on the obtained total liquid amount Vt.

DETAILED DESCRIPTION

Figure 1A:
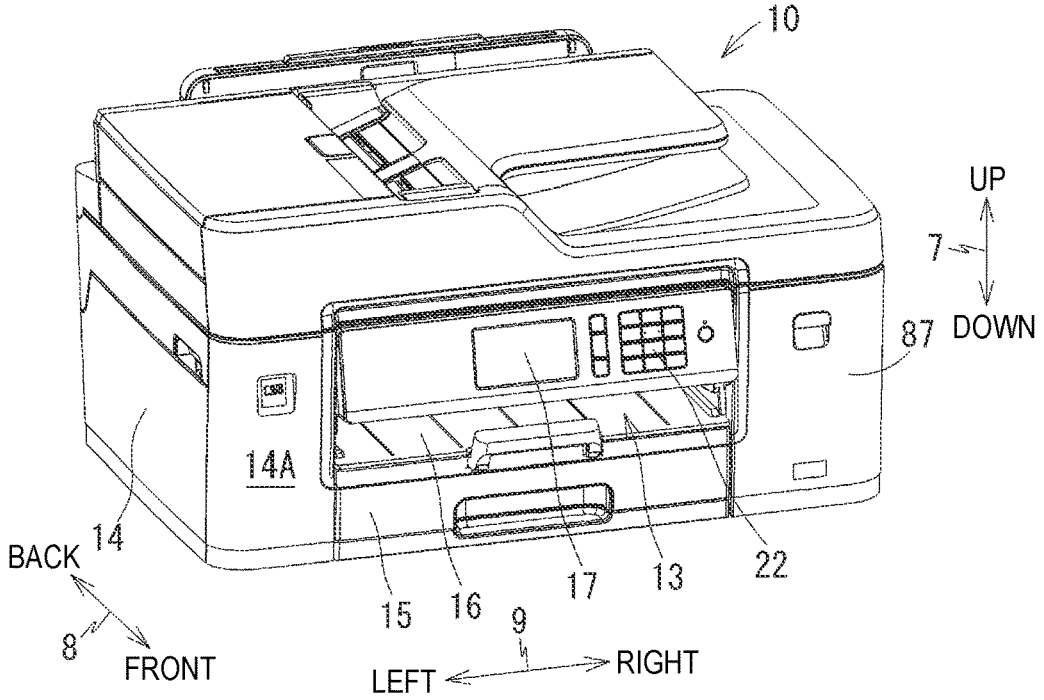
FIG. 1A is an external perspective view of a printer and illustrates a state where a cover is in a covering position.

In the above-explained related-art printer, when the image recording unit discharges ink, the amount of liquid stored in each of the main tank and the sub tank changes. For example, when the amount of ink stored in the cartridge is near zero, it is desirable to notify a user of necessity of cartridge exchange. On the other hand, when the amount of ink stored in the sub tank is near zero, it is desirable to notify the user and prohibit image recording so that air does not enter the image recording unit from the sub tank. Therefore, it is desirable to grasp the ink amounts of the main tank and the sub tank.

The disclosure has been made in view of the above circumstances, and an object thereof is to provide a liquid discharge device capable of individually grasping the amount of ink stored in each of a first liquid chamber and a second liquid chamber.

An exemplary embodiment of the disclosure will be described below. It is noted that the exemplary embodiment described below is merely an example of the disclosure and can be appropriately modified without departing from the spirit of the disclosure. In addition, an up and down direction 7 is defined with reference to a posture of a printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. In the exemplary embodiment, the up and down direction 7 in the use posture corresponds to a vertical direction, and the front and back direction 8 and the left and right direction 9 correspond to a horizontal direction. The front and back direction 8 and the left and right direction 9 are orthogonal to each other.

(Outline of Printer)

The printer 10 according to the exemplary embodiment is an example of a liquid discharge device that records an image on a sheet using an inkjet recording method. The printer 10 has a housing 14 having substantially rectangular parallelepiped shape. Further, the printer 10 may be a so-called "multifunction peripheral" having a facsimile function, a scan function, and a copy function.

Figure 1B:
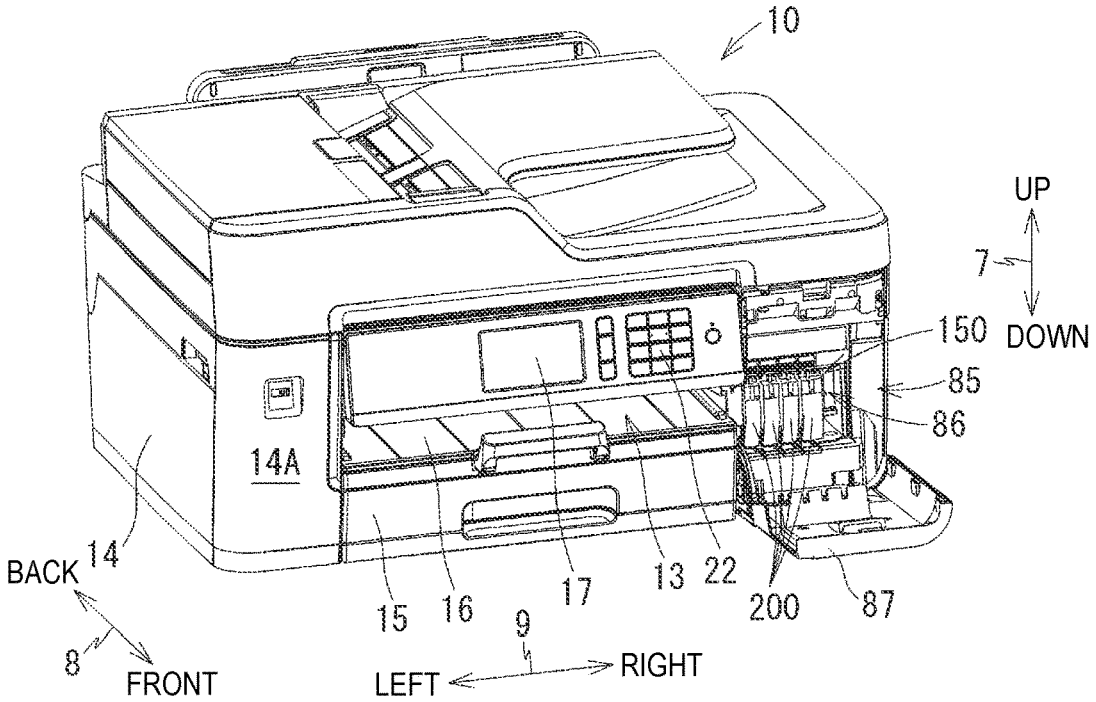
FIG. 1B is an external perspective view of the printer and illustrates a state where the cover is in an exposing position.
Figure 2:
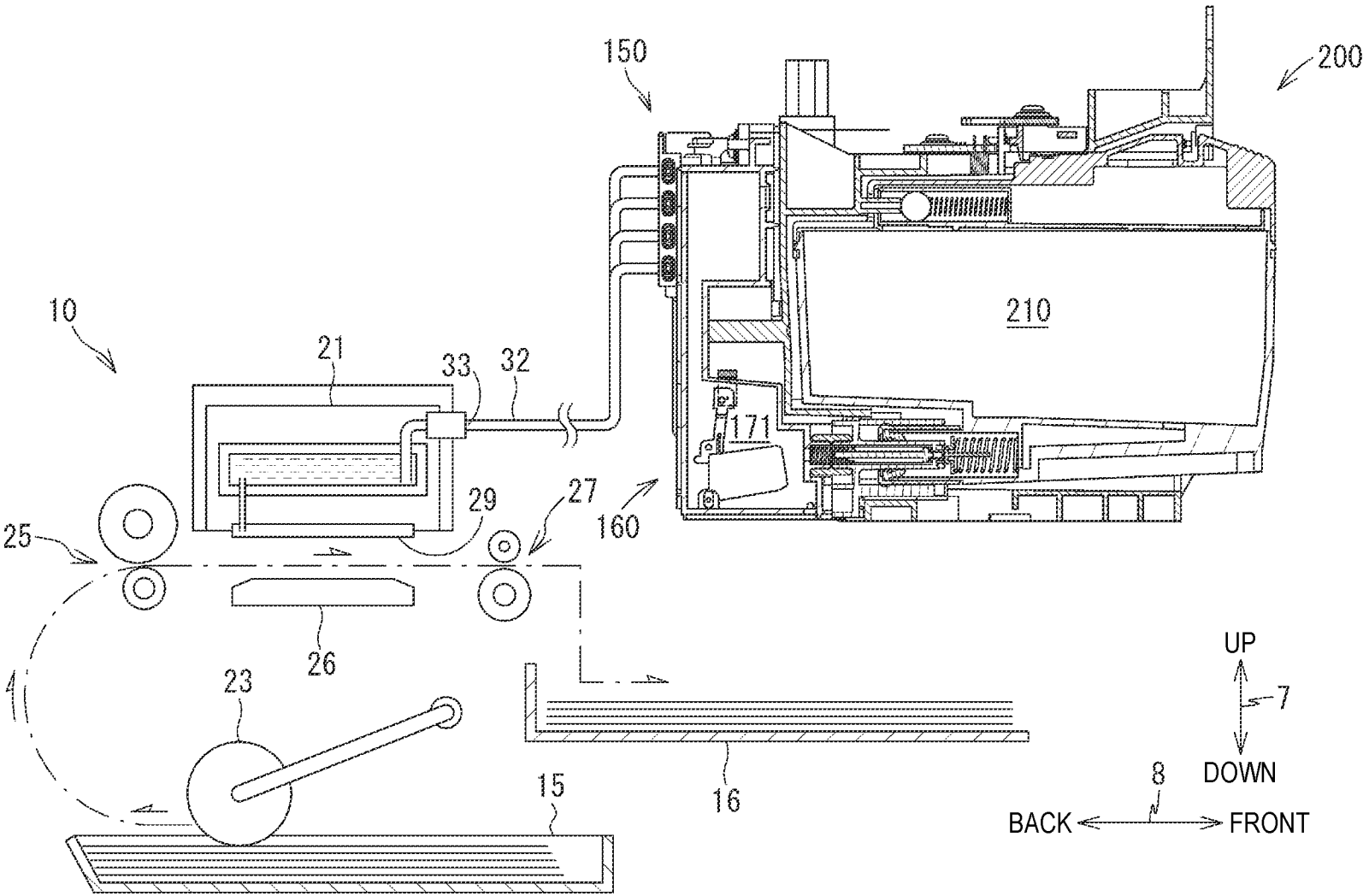
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

More specifically, the head 21 may be mounted on a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

In the exemplary embodiment, the discharge of ink from the nozzle 29 of the head 21 in the image recording is referred to as "jetting", while the discharge of ink from the nozzle 29 of the head 21 in the purging is referred to as "jetting", but the "jetting" is conceptually included in the "discharge".

(Cover)

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads backwards from the opening 85.

(Cover Sensor)

Figure 6:
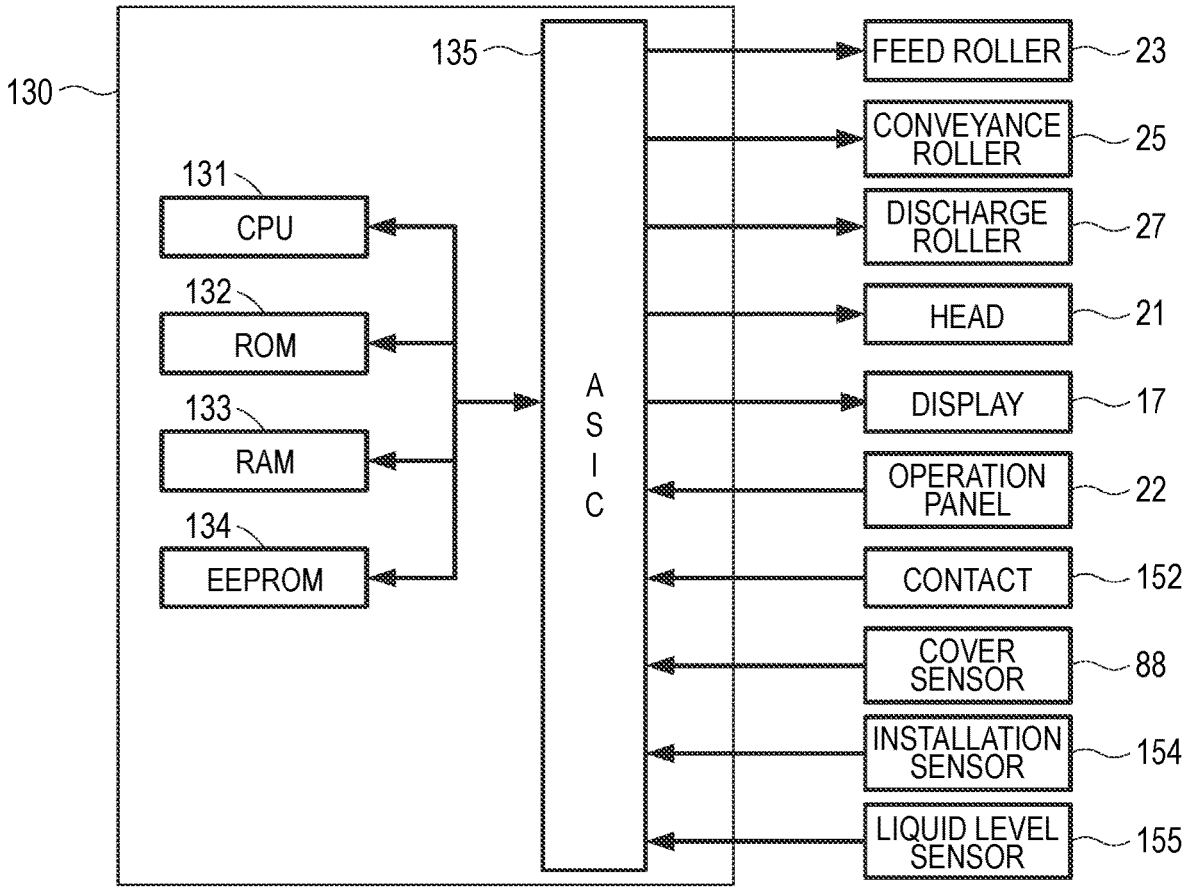
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal intensity than the low-level signal to the controller 130 when the cover 87 is located at a position different from the covering position. In other words, the cover sensor 88 outputs the high-level signal to the controller 130 when the cover 87 is located at the exposing position.

(Installation Case)

Figure 3:
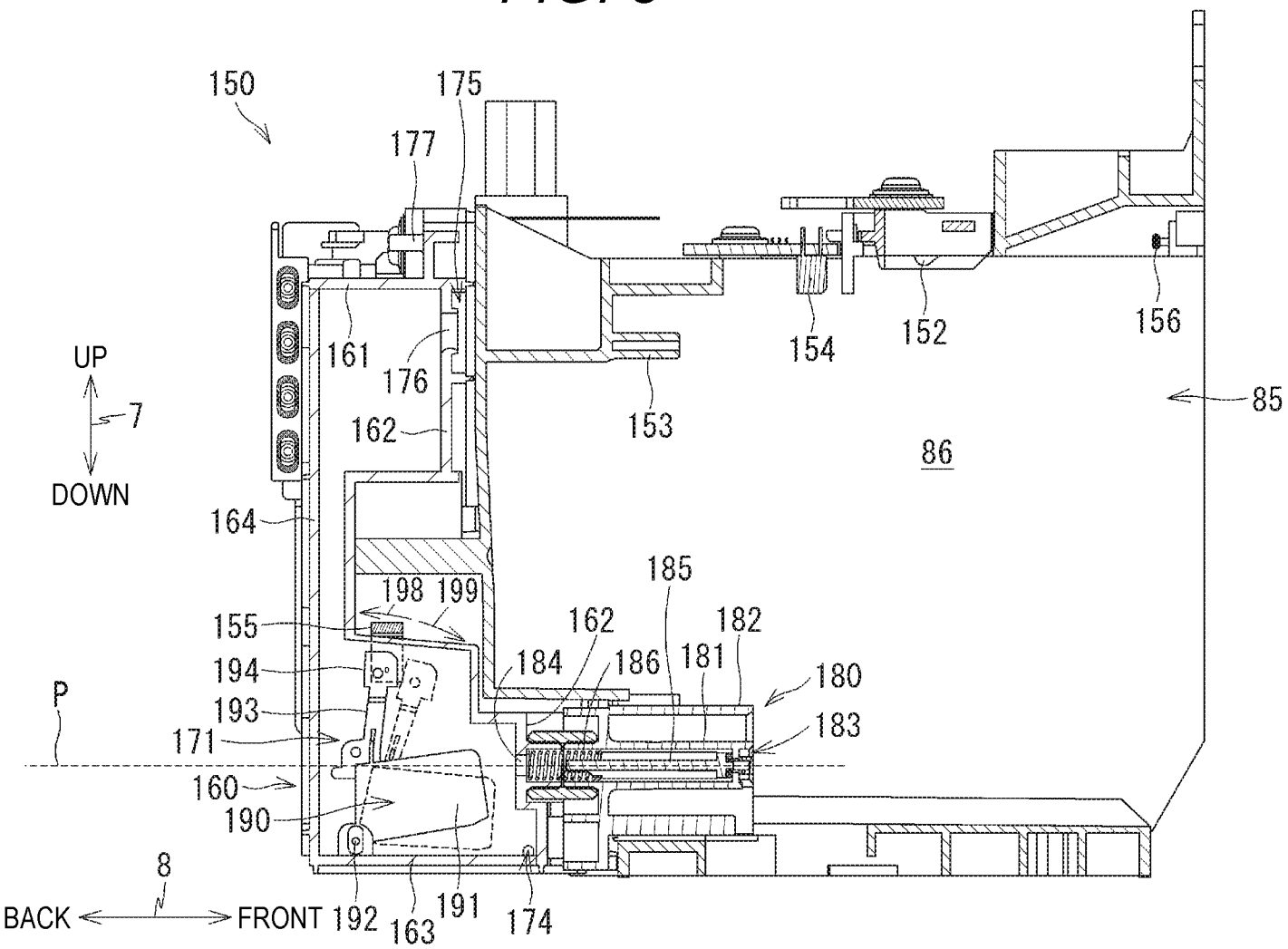
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be installed. The contact 152 is an example of an interface.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

(Contact)

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

(Rod)

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

(Installation Sensor)

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal to the controller when an intensity of the light received by the light receiving portion is lower than threshold intensity, for example. Meanwhile, the installation sensor 154 outputs a high-level signal having higher signal intensity than the low-level signal to the controller 130 when the intensity of the light received by the light receiving portion is equal to or higher than the threshold intensity.

(Liquid Level Sensor)

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion. The installation sensor 155 outputs a low-level signal to the controller when an intensity of the light received by the light receiving portion is lower than threshold intensity, for example. Meanwhile, the installation sensor 155 outputs a high-level signal having higher signal intensity than the low-level signal to the controller 130 when the intensity of the light received by the light receiving portion is equal to or higher than the threshold intensity. The detection target portion 194 is an example of a detection object. The high-level signal is an example of a second signal, and the low-level signal is an example of a first signal.

(Lock Pin)

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at an installation position illustrated in FIG. 5. The cartridge 200 is engaged with the lock pin 156 in a state of being installed in the installation case 150.

(Tank)

The printer 10 includes four tanks 160 corresponding to four cartridges 200. The tank 160 is located backwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through hole 184) in the up and down direction 7. The ink flow path (not illustrated) communicating with the outflow port 174 communicates with the tube 32 (see FIG. 2). Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a fourth flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through hole 176 penetrating the front wall 162. In addition, the air communication chamber 175 communicates with the outside of the printer 10 through an air communication port 177 and a tube (not illustrated) connected to the air communication port 177. That is, the air communication chamber 175 is an example of a fifth flow path in which one end (through hole 176) communicates with the liquid chamber 171 and the other end (air communication port 177) communicates with the outside of the printer 10. The air communication chamber 175 communicates with the air through the air communication port 177 and the tube (not illustrated).

(Joint)

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through hole 184 penetrating the front wall 162. The needle 181 is an example of a third flow path in which one end (opening 183) communicates with the outside of the tank 160 and the other end (through hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an open position in the front and back direction 8. The valve 185 closes the opening 183 when being positioned at the closed position. Further, the valve 185 opens the opening 183 when being located at the open position. The coil spring 186 urges forward the valve 185 in a moving direction from the open position to the closed position, that is, the front and back direction 8.

(Actuator)

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and back direction 8. The detection target portion 194 is formed of a material or color that shields the light output from the light emitting portion of the liquid level sensor 155. The detection target portion 194 is an example of a detection object.

When a liquid level of the ink stored in the liquid chamber 171 is equal to or higher than a predetermined position P, the actuator 190 rotated in the direction of the arrow 198 by buoyancy is held at the detection position indicated by the solid line in FIG. 3, by the stopper. On the other hand, when the liquid level of the ink is lower than the predetermined position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The predetermined position P has the same height as an axial center of the needle 181 in the up and down direction 7, and has the same height as a center of an ink supply port 234 (to be described below). However, the predetermined position P is not limited to the position as long as it is located above the outflow port 174 in the up and down direction 7. As another example, the predetermined position P may be a height of the upper end or the lower end of the internal space of the needle 181, or may be a height of an upper end or a lower end of the ink supply port 234.

When the liquid level of the ink stored in the liquid chamber 171 is equal to or higher than the predetermined position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the predetermined position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the predetermined position P.

(Cartridge)

Figure 4A:
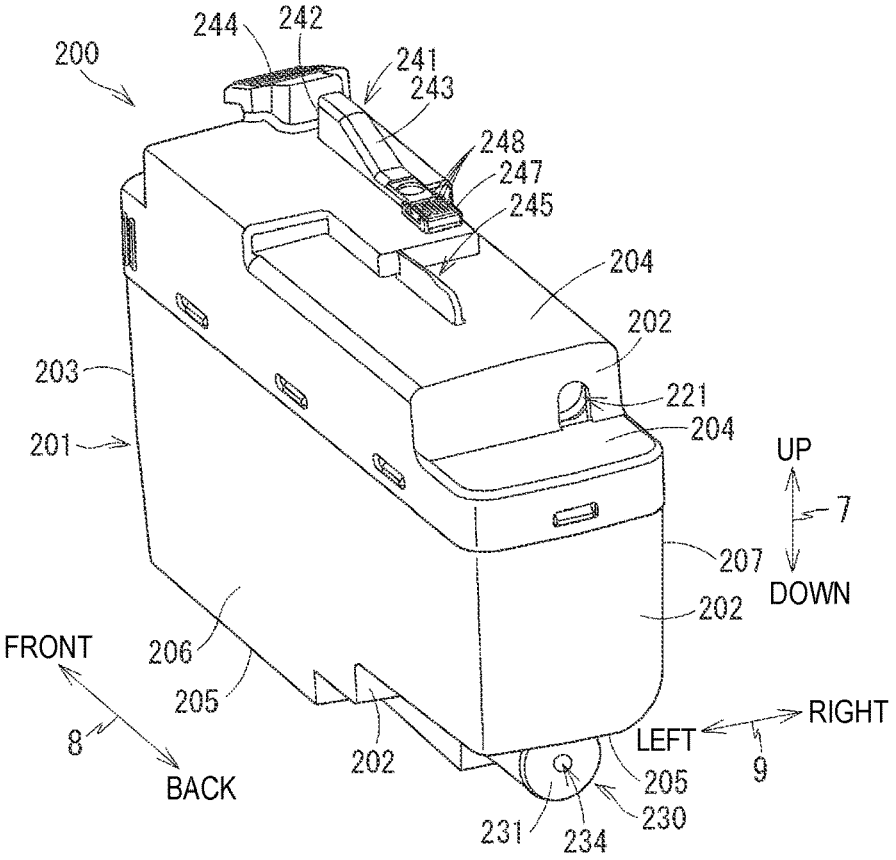
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 4B:
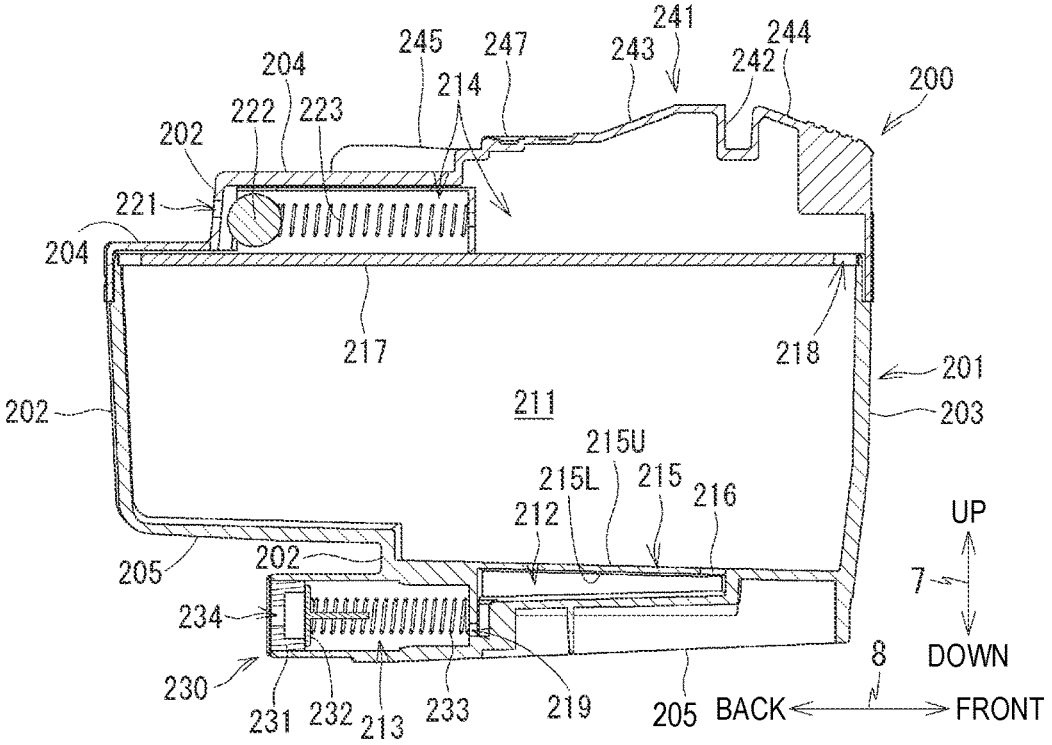
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber. The upper liquid chamber 211 is an example of a first portion, and the lower liquid chamber 212 is an example of a second portion.

The upper liquid chamber 211 and the lower liquid chamber 212 of the liquid chamber 210 are separated from each other in the up and down direction 7 by a partition wall 215 (an example of a wall) that partitions the internal space of the housing 201. Then, the upper liquid chamber 211 and the lower liquid chamber 212 communicate with each other through a through hole 216 formed in the partition wall 215. In addition, the upper liquid chamber 211 and the air valve chamber 214 are separated from each other in the up and down direction 7 by a partition wall 217 that partitions the internal space of the housing 201. An upper surface 215U (an example of a first surface) of the partition wall 215 partitions the upper liquid chamber 211. A lower surface 215L (an example of a second surface) partitions the lower liquid chamber 212. Then, the upper liquid chamber 211 and the air valve chamber 214 communicate with each other through a through hole 218 formed in the partition wall 217. Further, the ink valve chamber 213 communicates with a lower end of the lower liquid chamber 212 through a through hole 219.

The air valve chamber 214 communicates with the outside of the cartridge 200 through the air communication port 221 formed in the rear wall 202 at the upper part of the cartridge 200. That is, the air valve chamber 214 is an example of a second flow path in which one end (through hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an open position in the front and back direction 8. When being located at the closed position, the valve 222 closes the air communication port 221. Further, when being located at the open position, the valve 222 opens the air communication port 221. The coil spring 223 urges backward the valve 222 in a moving direction from the open position to the closed position, that is, the front and back direction 8.

The rod 153 enters the air valve chamber 214 through the air communication port 221 in the course of installing the cartridge 200 on the installation case 150. The rod 153 having entered the air valve chamber 214 moves forward the valve 222 located at the closed position against an urging force of the coil spring 223. Then, as the valve 222 moves to the open position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through hole 219 and the outside of the cartridge 200 to communicate with each other. The ink valve chamber 213 is an example of a first flow path in which one end (through hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and back direction 8 is formed. An inner diameter of the ink supply port 234 is slightly smaller than an outer diameter of the needle 181. The valve 232 is movable between a closed position and an open position in the front and back direction 8. When being located at the closed position, the valve 232 comes in contact with the packing 231 and closes the ink supply port 234. Further, when being located at the open position, the valve 232 separates from the packing 231 and opens the ink supply port 234. The coil spring 233 urges backward the valve 232 in a moving direction from the open position to the closed position, that is, the front and back direction 8. In addition, the urging force of the coil spring 233 is larger than that of the coil spring 186.

The supply tube 230 enters the guide 182 in the course of installing the cartridge 200 on the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
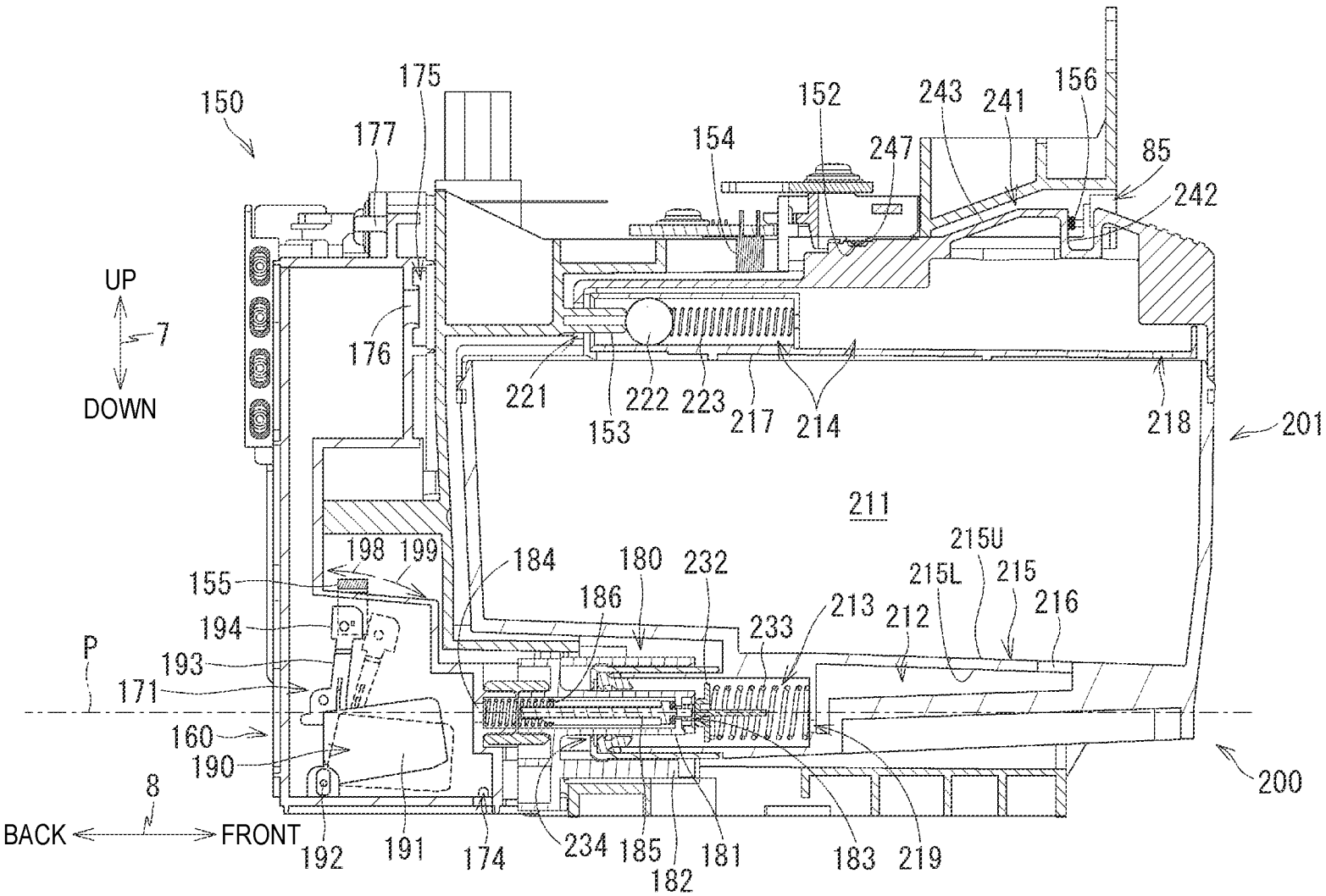
FIG. 5 is a longitudinal sectional view illustrating a state where the cartridge is installed in the installation case.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference through the connected supply tube 230 and the joint 180.

As illustrated in FIG. 4, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and back direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC substrate 247 is located on the outer surface of the upper wall 204 and between the light shielding rib 245 and the projection 241 in the front and back direction 8. On the IC substrate 247, an electrode 248 is formed. In addition, the IC substrate 247 includes a memory (not illustrated). The electrode 248 is electrically connected to the memory of the IC substrate 247. The electrode 248 is exposed on an upper surface of the IC substrate 247 so as to be electrically connectable with the contact 152. That is, the electrode 248 is electrically connected to the contact 152 in the state where the cartridge 200 is installed in the installation case 150. The controller 130 can read information from the memory of the IC substrate 247 through the contact 152 and the electrode 248, and can write information to the memory of the IC substrate 247 through the contact 152 and the electrode 248. The IC substrate 247 is an example of a cartridge memory.

The memory of the IC substrate 247 stores an ink amount Vc and identification information for identifying the individual of the cartridge 200. An initial ink amount Vc0 is stored, as the ink amount Vc, in the memory of the IC substrate 247 of a new cartridge 200. The initial ink amount Vc0 indicates the amount of ink that can be stored in the new cartridge 200. Hereinafter, information stored in the memory of the IC substrate 247 may be collectively referred to as "CTG information" in some cases. Further, the "new" is a so-called unused item and indicates a state in which the ink stored in the cartridge 200 has never flowed out from the cartridge 200 which is manufactured and sold.

A storage region of the memory of the IC substrate 247 includes, for example, a region where information is not overwritten by the controller 130 and a region where information can be overwritten by the controller 130. For example, identification information is stored in the non-overwritable region that is not overwritten, and the ink amount Vc is stored in the overwritable region.

(Controller)

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of memories.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

Further, a display 17 and an operation panel 22 are connected to the ASIC 135. The display 17 is a liquid crystal display, an organic EL display, or the like, and includes a display screen on which various types of information are displayed. The display 17 is an example of a notification device. However, specific examples of the notification device are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display 17.

Further, the ASIC 135 is connected with the contact 152, the cover sensor 88, the installation sensor 154, and the liquid level sensor 155. The controller 130 accesses the memory of the IC substrate 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the predetermined position P.

When liquid level sensor 155 outputs a high-level signal, the ROM 132 stores a predetermined ink amount Vsc (an example of a fixed value A) stored in the liquid chamber 171 of the tank 160 and a predetermined ink amount Vcc stored in the liquid chamber of the cartridge 200. The predetermined ink amount Vcc is zero in the embodiment.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, functions F1 and F2, a C_Empty flag, an S_Empty flag, a count value SN, a count value TN, and a threshold $N_{th}$.

The ink amount Vc and the identification information are information read by the controller 130 from the memory of the IC substrate 247 through the contact 152 in a state where the cartridge 200 is installed in the installation case 150. The functions F1 and F2 may be stored in the ROM 132 instead of the EEPROM 134.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by the function F1 or the function F2.

The functions F1 and F2 are information indicating a corresponding relation of the total amount Vt of ink, the ink amount Vc, and the ink amount Vc. The ink in the liquid chamber 210 of the cartridge 200 and the ink in the liquid chamber 171 of the tank 160 are in equilibrium in a state where positions in the vertical direction 7 of the liquid levels of the respective inks coincide with each other. That is, in the equilibrium state, the movement of the ink between the liquid chamber 210 and the liquid chamber 171 is stopped. In the equilibrium state, the relation between the total amount Vt of ink and the ink amount Vs can be approximated using an actually measured value as a function. The functions F1 and F2 are examples of arithmetic expressions.

Figure 9:
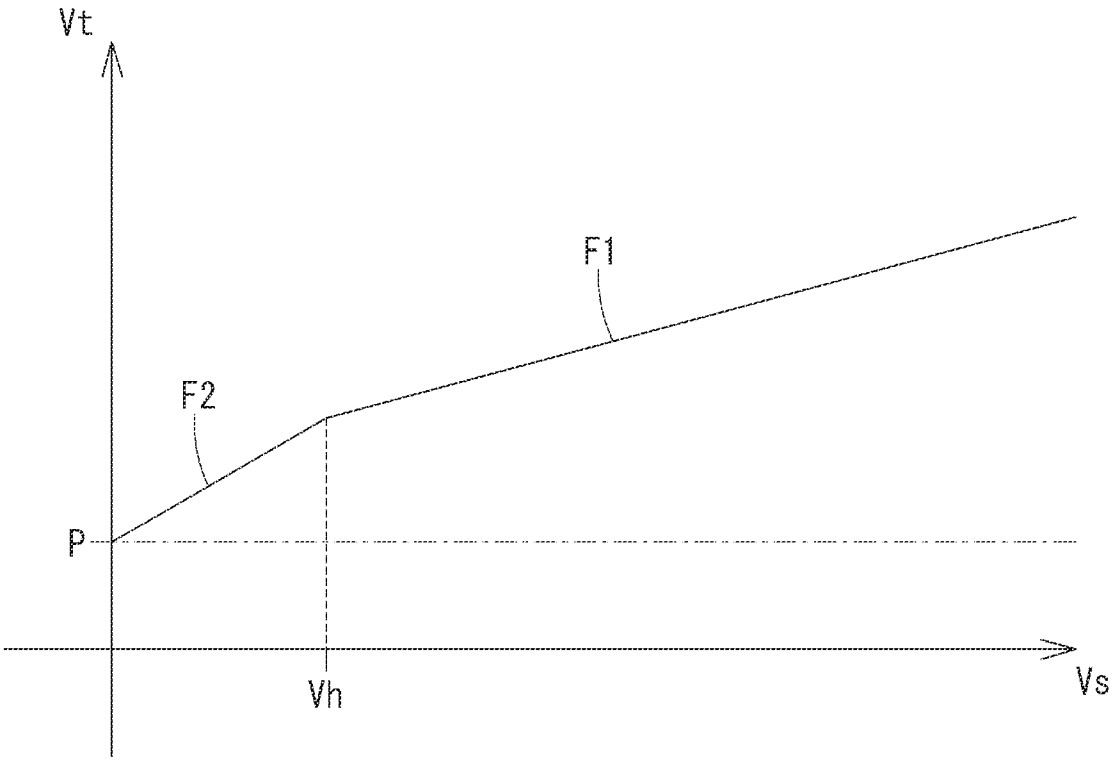
FIG. 9 is a diagram illustrating functions.

As illustrated FIG. 9, the relation between the total amount Vt and the ink amount Vs can be approximated by two functions F1 and F2. The function F1 indicates a relation between the total amount Vt and the ink amount Vs when the total amount Vt is equal to or greater than the threshold Vh, and is expressed by, for example, $Vs=a\times Vt+b$ (a and b are constant). The function F2 indicates a relation between the total amount Vt and the ink amount Vs when the total amount Vt is smaller than the threshold Vh, and is expressed by, for example, $Vs=c\times Vt+d$ (c and d are constant). The function F1 is an example of a first arithmetic expression and correlation information. The function F2 is an example of a second arithmetic expression and correlation information.

The threshold Vh is a value corresponding to the total amount Vt when the liquid level of the ink stored in the upper liquid chamber 211 of the liquid chamber 210 of the cartridge 200 comes into contact with the upper surface 215U or the lower surface 215L of the partition wall 215. Therefore, when the liquid level of the ink is above the partition wall 215 in the liquid chamber 210 of the cartridge 200, that is, when the total amount Vt is equal to or greater than the threshold Vh, the ink amount Vs is calculated by the function F1. When the liquid level of the ink is in contact with the partition wall 215 or is below the partition wall 215 in the liquid chamber 210 of the cartridge 200, that is, when the total amount Vt is smaller than the threshold Vh, the ink amount Vs is calculated by the function F2. The ink amount Vc is calculated as a difference between the total amount Vt and the ink amount Vs. The threshold Vh is an example of a first threshold.

The count value SN is a value equivalent to an ink discharge amount Dh (that is, the ink amount indicated by the driving signal) instructed to be discharged from the head 21 and is a value that is updated closer to the threshold $N_{th}$, after the signal output from the liquid level sensor 155 changes from the low-level signal to the high-level signal. The count value SN is a value counted up with an initial value being "0". In addition, the threshold $N_{th}$ is equivalent to a volume of the liquid chamber 171 between the vicinity of the upper end of the outflow port 174 and the predetermined position P. However, the count value SN may be a value counted down with a value equivalent to the volume as an initial value. In this case, the threshold $N_{th}$ is zero (0). The count value SN is an example of a second count value.

The count value TN is a value equivalent to an ink discharge amount Dh (that is, the ink amount indicated by the driving signal) instructed to be discharged from the head 21 and is a value counted up with an initial value being "0", after the signal output from the liquid level sensor 154 changes from the high-level signal to the low-level signal. Further the count value TN may be a value counted down with a value equivalent to the total amount Vt of ink as an initial value. The count value TN is an example of a first count value.

The C_Empty flag is information indicating whether the cartridge 200 is in a cartridge empty state. In the C_Empty flag, a value "ON" corresponding to the cartridge empty state or a value "OFF" corresponding to non-cartridge empty state is set. The cartridge empty state is a state where ink is not substantially stored in the cartridge 200 (more specifically, the liquid chamber 210). In other words, the cartridge empty state is a state where ink does not move from the liquid chamber 210 to the liquid chamber 171 communicating with the cartridge 200. Namely, the cartridge empty state is a state where the liquid level of the tank 160 communicating with the cartridge 200 is lower than the predetermined position P.

The S_Empty flag is information indicating whether the tank 160 is in an ink empty state. In the S_Empty flag, a value "ON" corresponding to the ink empty state or a value "OFF" corresponding to non-ink empty state is set. The ink empty state is, for example, a state where the liquid level of the ink stored in the tank 160 (more specifically, the liquid chamber 171) reaches the position of the upper end of the outflow port 174. In other words, the ink empty state is a state where the count value SN is equal to or larger than the threshold $N_{th}$. When the ink is continuously discharged from the head 21 after the ink empty state, the liquid level of the ink in the tank 160 may fall below the upper end of the outflow port 174, and air may be mixed in an ink flow path from the tank 160 to the head 21 or in the head 21 (so called air-in). As a result, the inside of the nozzle 29 is filled with the ink, and the ink may not be discharged.

(Operation of Printer)

An operation of the printer 10 according to the embodiment will be described with reference to FIGS. 7 to 10. Each of processes illustrated in FIGS. 7 to 10 is executed by the CPU 131 of the controller 130. Each of the following processes may be executed by the CPU 131 reading programs stored in the ROM 132, or may be implemented a hardware circuit installed in the controller 130. Further, execution orders of the following processes can be appropriately changed within the scope of the disclosure.

(Image Recording Process)

Figure 7:
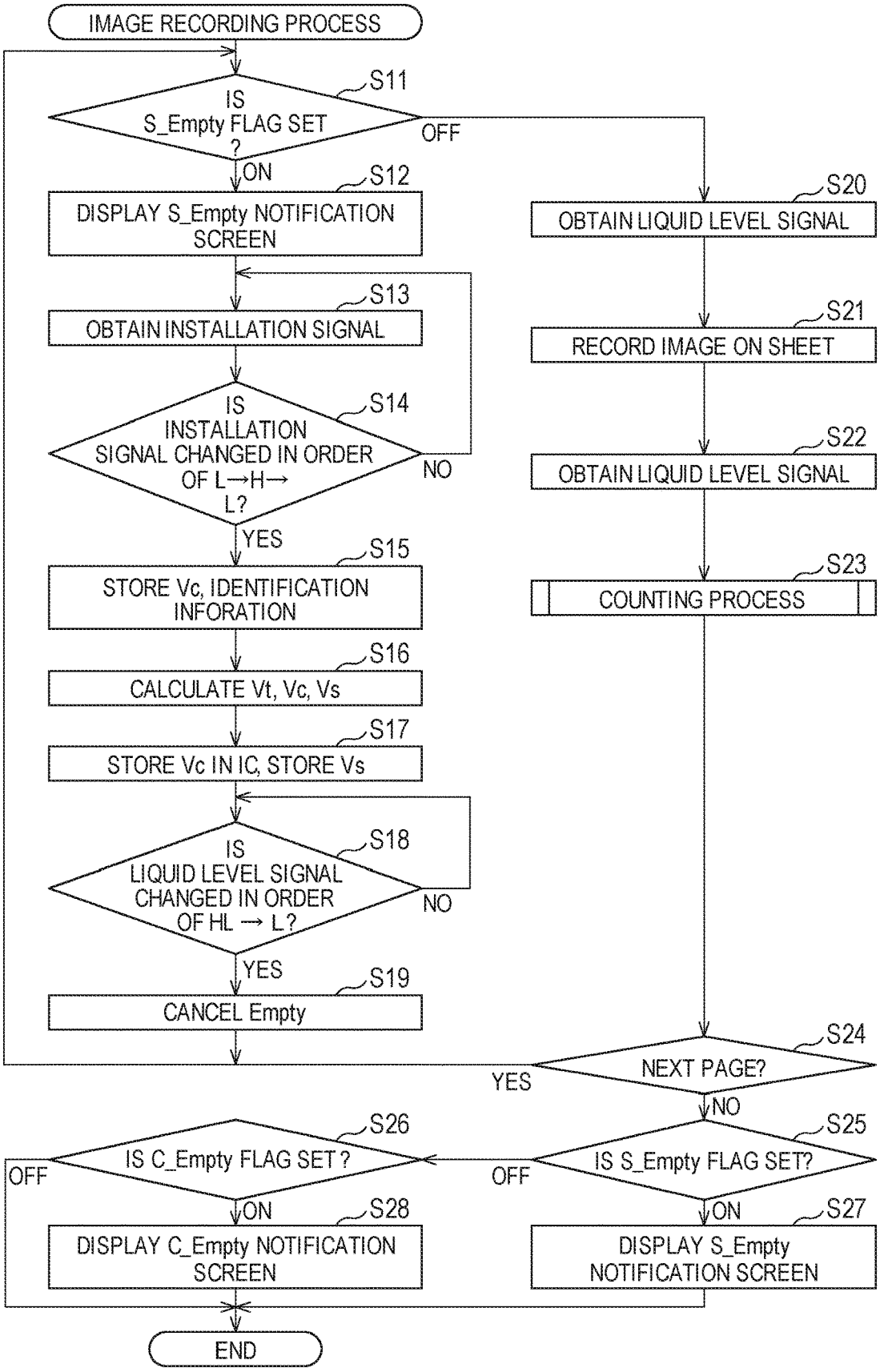
FIG. 7 is a flowchart of an image recording process.

The controller 130 executes an image recording process illustrated in FIG. 7 in response to a recording instruction being input to the printer 10. The recording instruction is an example of first and second discharge instructions for causing the printer 10 to execute a recording process of recording an image indicated by image data on a sheet. An acquisition destination of the recording instruction is not particularly limited, but, for example, a user's operation corresponding to the recording instruction may be accepted through the operation panel 22 or may be received from an external device through a communication interface (not illustrated).

First, the controller 130 determines set values of four S_Empty flags (S11). Then, the controller 130 displays an S_Empty notification screen on the display 17 in response to determining that at least one of the four S_Empty flags is set to "ON" (S11: ON) (S12). The S_Empty notification screen is a screen for notifying the user that the corresponding tank 160 has entered the ink empty state. For example, the S_Empty notification screen may include information relating to the color and the ink amounts Vc and Vs of the ink stored in the tank 160 being in the ink empty state. In step S12, the controller 130 may display the C_Empty notification screen on the display 17 together with the S_Empty notification screen in response to determining that at least one of the four C_Empty flags is set to "ON".

In addition, the controller 130 executes processes S13 to S19 for each the cartridge 200 corresponding to the S_Empty flag set to "ON". That is, the processes is executed for each the cartridge 200 among the four cartridges 200 in which the S_Empty flag is set to "ON". Since the processes S13 to S19 for each the cartridge 200 is common, only the processes S13 to S19 corresponding to one cartridge 200 will be described.

First, the controller 130 obtains a signal output from the installation sensor 154 (S13). Next, the controller 130 determines whether the signal obtained from the installation sensor 154 is a high-level signal or a low-level signal (S14). Then, the controller 130 repeatedly executes the processes S13 and S14 at predetermined time intervals until the signal output from the installation sensor 154 changes into the high-level signal from the low-level signal and changes into the low-level signal from the high-level signal again (S14: No). In other words, the controller 130 repeatedly executes the processes S13 and S14 until the cartridge 200 is removed from the installation case 150 and a new cartridge 200 is installed in the installation case 150.

Then, the controller 130 obtains the high-level signal from the installation sensor 154 after obtaining the low-level signal from the installation sensor 154, and then executes the high-level signal from the installation sensor 154 (S14: Yes), thereby executing step S15. That is, the controller 130 reads identification information and ink amount Vc from the IC substrate 247 of the cartridge 200 through the contact 152, and stores it in the EEPROM 134 (S15). At this time, the controller 130 updates the ink amount Vc stored in the EEPROM 134 with the ink amount Vc read from the IC substrate 247.

In addition, the controller 130 calculates the total amount Vt after cartridge exchange (S16). In detail, the controller 130 calculates the ink amount Vs (Vs=Vsc−SN) before cartridge exchange based on the count value SN before cartridge exchange stored in the EEPROM 134 and the ink amount Vsc stored in the ROM 132 and stores the ink amount in the EPROM 134. The ink amount Vs before cartridge exchange is equal to the total amount Vt before cartridge exchange. Based on the calculated ink amount Vs and the ink amount Vc read from the IC substrate 247 of the cartridge 200 after exchange, the total amount Vt after cartridge exchange is calculated. That is, when the cartridge 200 is exchanged, the ink amount Vc stored in the liquid chamber 210 of the new cartridge 200 is added to the ink amount Vs (=Vsc−SN) stored in the liquid chamber 171 of the tank 160 immediately before the cartridge 200 is exchanged. Accordingly, the controller 130 calculates the sum of the ink amount Vc read from the IC substrate 247 of the exchanged cartridge 200 and the ink amount Vs before cartridge exchange stored in the EEPROM 134 as the total amount Vt (Vt=Vs+Vc).

The controller 130 calculates the ink amount Vc and the ink amount Vs when the movement of ink from the liquid chamber 210 to the liquid chamber 171 is completed based on the calculated total amount Vt and the function F1 or the function F2 read from the EEPROM 134 (S16). When the cartridge is exchanged, the ink stored in the liquid chamber 210 of the new cartridge 200 flows into the liquid chamber 171 of the tank 160 through an ink needle 181. As a result, the ink amount Vc of the liquid chamber 210 decreases, and the ink amount Vs of the liquid chamber 171 increases. Then, the ink in the liquid chamber 210 of the cartridge 200 and the ink in the liquid chamber 171 of the tank 160 are in equilibrium in a state where positions in the vertical direction 7 of the liquid levels of the respective inks coincide with each other.

The controller 130 determines whether the calculated total amount Vt is equal to or greater than the threshold Vh. For example, when the new cartridge 200 is installed in the installation case 150, the total amount Vt is equal to or greater than the threshold Vh. The controller 130 calculates the ink amount Vs from the total amount Vt using the function F1 when the total amount Vt is equal to or greater than the threshold Vh. Then, the controller 130 stores the calculated ink amount Vs in the EEPROM 134 (S17). At this time, the controller 130 updates the ink amount Vs stored in the EEPROM 134 with the calculated ink amount Vs. In addition, the controller 130 stores the calculated ink amount Vc in the memory of the IC substrate 247 through the contact 152 (S17). At this time, the controller 130 updates the ink amount Vc stored in the memory of the IC substrate 247 with the calculated ink amount Vc.

Subsequently, the controller 130 determines whether the signal received from the liquid level sensor 155 changes from the high-level signal to the low-level signal (S18). When the new cartridge 200 is installed in the installation case 150, the ink flows into the liquid chamber 171 of the tank 160 from the liquid chamber 210 of the cartridge 200. Then, when the liquid level of the ink in the liquid chamber 171 reaches the predetermined position P, the signal output from the liquid level sensor 155 changes from the high-level signal to the low-level signal. The controller 130 repeats the determination of S18 until receiving the low-level signal when the signal received from the liquid level sensor 155 remains in a state of the high-level signal (S18: No). That is, the controller 130 waits until the liquid level of the ink in the liquid chamber 171 rises to the predetermined position P.

The controller 130 sets the S_Empty flag and the C_Empty flag to "OFF" in response to determining that the signal received from the liquid level sensor 155 changes from the high-level signal to the low-level signal (S18: Yes). In addition, the controller 130 erases one of the S_Empty notification screen and the C_Empty notification screen which is being displayed, from the display 17 (S19). Further, the controller 130 displays the calculated ink amount Vc and ink amount Vs on the display 17. The controller 130 may display the calculated total amount Vt on the display 17. The total amount Vt and the ink amounts Vc and Vs may be numerically displayed, or may be displayed by an image such as a bar index. In addition, both the ink amount Vc and the ink amount Vs are not necessarily displayed, and at least a part, for example, only the ink amount Vc may be displayed. Then, the controller 130 executes processes subsequent to step S11 again.

The controller 130 obtains signals output from four liquid level sensors 155 at the present time when all the S_Empty flags corresponding to all the cartridges 200 are not "ON", that is, are "OFF" (S20). In S17, the controller 130 further causes the RAM 133 to store information indicating whether the signal obtained from the liquid level sensor 155 is a high-level signal or a low-level signal.

Then, the controller 130 records the image indicated by the image data included in the recording instruction on the sheet (S21). More specifically, the controller 130 causes the sheet on the feed tray 15 to be conveyed to the feed roller 23 and the conveyance roller 25, causes the head 21 to discharge the ink, and causes one sheet, on which the image is recorded, to be discharged to the discharge roller 27 via the discharge tray 16. That is, the controller 130 permits the discharge of the ink through the head 21 when all of the four S_Empty flags are set to "OFF". Meanwhile, the controller 130 prohibits the discharge of the ink through the head 21 when at least one of the four S_Empty flags is set to "ON".

Next, the controller 130 obtains signals output from the four liquid level sensors 155 at the present time in response to recording the image on one sheet according to the recording instruction (S22). Further, similarly to step S20, the controller 130 causes the RAM 133 to store information indicating whether the signal obtained from the liquid level sensor 155 is a high-level signal or a low-level signal (S22). Then, the controller 130 executes a counting process (S23). The counting process is a process of updating the count values TN, SN, the C_Empty flag, and the S_Empty flag based on the signal obtained from the liquid level sensor 155 in steps S20 and S22. Details of the counting process will be described below with reference to FIG. 8.

Next, the controller 130 repeatedly executes the processes S11 to S24 until all the images indicated by the recording instruction are recorded on the sheet (S24: Yes). Then, the controller 130 determines set values of the four S_Empty flags and set values of the four C_Empty flags in response to recording all the images indicated by the recording instruction on the sheet (S24: No) (S25 and S26).

When at least one of the four S_Empty flags is set to "ON" (S25: ON), the controller 130 displays the S_Empty notification screen on the display 17 (S27). In addition, when all of the four S_Empty flags are set to "OFF" and at least one of the four C_Empty flags is set to "ON" (S25: OFF & S26: ON), the controller 130 displays the C_Empty notification screen on the display 17 (S28). The processes S25 and S26 are examples of operating the notification device.

The S_Empty notification screen displayed in step S24 may be the same as in step S12. In addition, the C_Empty notification screen is a screen for notifying the user that the cartridge 200 corresponding to the C_Empty flag set to "ON" has entered the cartridge empty state. For example, the C_Empty notification screen may include information related to the color and the ink amounts Vc and Vs of the ink stored in the cartridge 200 being in the cartridge empty state.

On the other hand, when all of the four S_Empty flags and the four C_Empty flags are set to "OFF" (S26: OFF), the controller 130 completes the image recording process.

A specific example of the discharge instruction is not limited to the recording instruction, but may be a maintenance instruction instructing maintenance of the nozzle 29 such as a purge. For example, the controller 130 executes the same processes as in FIG. 7 in response to obtaining the maintenance instruction through the operation panel 22. Differences from the above-described processes in the case of obtaining the maintenance instruction are as follows. First, the controller 130 drives a maintenance mechanism (not illustrated) in step S21, and discharges the ink through the nozzle 29. In addition, the controller 130 executes the processes of step S24 and the subsequent steps without executing step S24 after executing the counting process.

(Counting Process)

Figure 8:
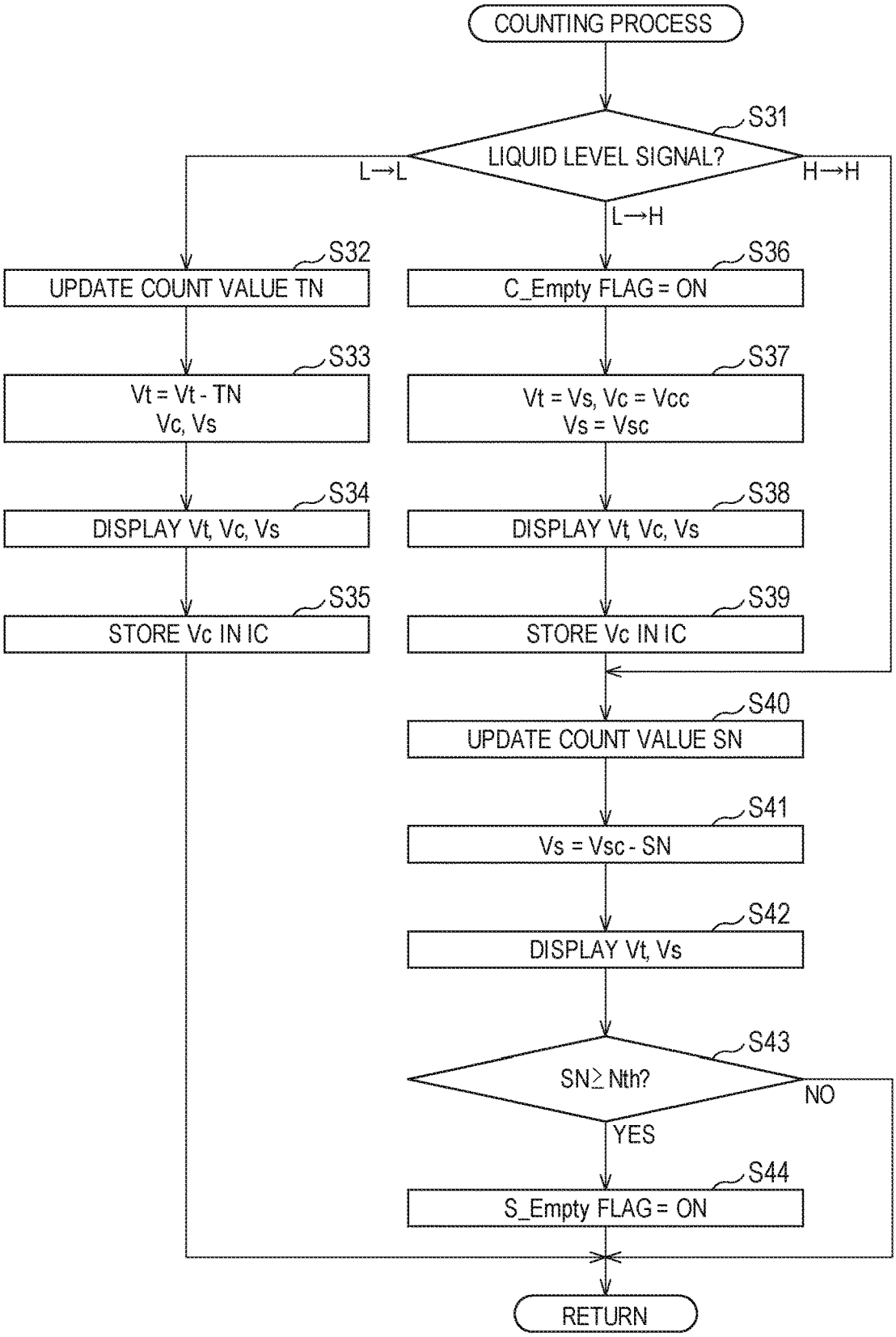
FIG. 8 is a flowchart of a counting process.

Next, details of the counting process executed by the controller 130 in S23 will be described with reference to FIG. 8. The controller 130 independently executes the counting process with respect to each of the four cartridges 200. Since the counting process is common for each cartridge 200, only the counting process corresponding to one cartridge 200 will be described.

First, the controller 130 compares information indicating the signals of the liquid level sensors 155 stored in the RAM 133 in S20 and S22 with one another (S31). That is, the controller 130 determines a change in the signal of each of the four liquid level sensors 155 before and after the process of S19 is executed immediately before the counting process (S23) is executed.

The controller 130 executes the residual amount updating process in response to the fact (S31: L→L) that the information stored in the RAM 133 in steps S20 and S22 indicates the low-level signal (that is, there is no change in the output of the liquid level sensors 155 before and after the process of S21) (S32). That is, the controller 130 counts up the count value TN which is a value equivalent to the amount of ink instructed to be discharged in the previous step S21.

In addition, the controller 130 calculates the current total amount Vt (S33). First, the controller 130 calculates the total amount Vt of the exchanged cartridge which is the sum of the ink amount Vc and the ink amount Vs stored in the EEPROM 134 after exchange of the cartridge. Then, the controller 130 calculates the current total amount Vt (Vt=Vt−TN) which is a value obtained by subtracting the ink amount equivalent to the count value TN from the calculated total amount Vt. Then, the controller 130 obtains the ink amounts Vc and Vs based on the calculated current total amount Vt and the function F1 or the function F2 (S33).

The controller 130 determines whether the calculated current total amount Vt is equal to or greater than the threshold Vh. The controller 130 calculates the ink amount Vs from the current total amount Vt using the function F1 when the current total amount Vt is equal to or greater than the threshold Vh. On the other hand, the controller 130 calculates the ink amount Vs from the current total amount Vt using the function F2 when the current total amount Vt is smaller than the threshold Vh. Then, the controller 130 calculates the ink amount Vc by subtracting the calculated ink amount Vs from the current total amount Vt.

Subsequently, the controller 130 displays either one of both the calculated ink amount Vc and the ink amount Vs and the calculated total amount Vt on the display 17 (S34). In addition, the controller 130 updates the ink amount Vc stored in the memory of the IC substrate 247 of the cartridge 200 with the calculated ink amount Vc (S35).

Figure 10A:
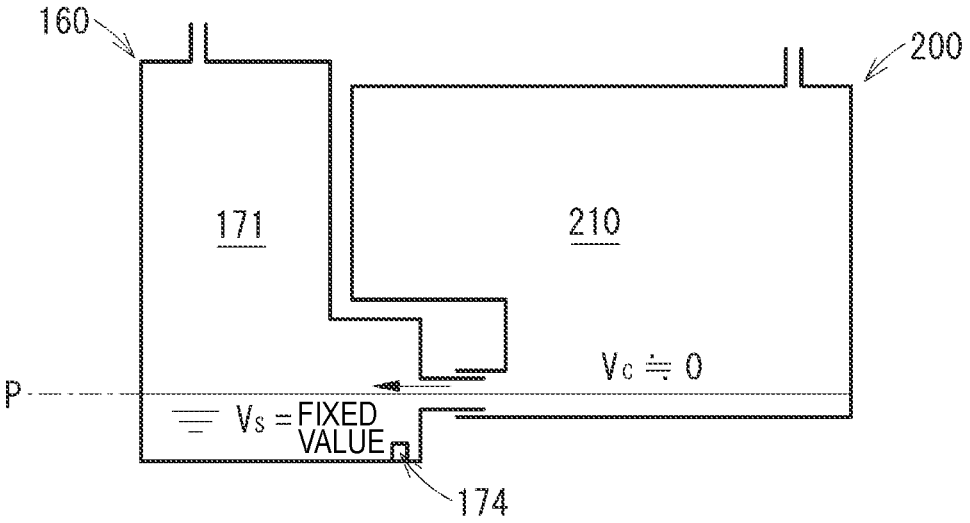
FIG. 10A is a schematic view illustrating a state where a cartridge communicates with a tank and illustrates a state where a cartridge is empty.

Further, the controller 130 substitutes "ON" for the C_Empty flag in response to the fact (S31: L→H) that the information stored in the RAM 133 in S20 indicates the low-level signal and the information stored in the RAM 133 in S22 indicates the high-level signal (that is, there is change in the output of the liquid level sensors 155 before and after the process of S21) (S36). The change from the low-level signal into the high-level signal in the output of the liquid level sensors 155 corresponds to the fact that the liquid level of the liquid chamber 171 reaches the predetermined position P during the process of S21 as illustrated in FIG. 10A. Then, there is no ink movement between the cartridge 200 and the tank 160.

In addition, the controller 130 reads a predetermined ink amount Vcc (=0) from the ROM 132, and sets the ink amount Vc to the predetermined ink amount Vcc (S37). Similarly, the controller 130 reads a predetermined ink amount Vsc (corresponding to the volume of the liquid chamber 171 below the predetermined position P) from the ROM 132, and sets the ink amount Vs to the predetermined ink amount Vsc (S37). Since the ink amounts Vc and Vs calculated in the residual amount updating process include errors, the controller 130 sets the ink amount Vc to the predetermined ink amount Vcc at the timing when the output of the liquid level sensor 155 changes from the low-level signal to the high-level signal, and sets the ink amount Vs to the predetermined ink amount Vsc, thereby resetting the accumulated errors. Further, the controller 130 calculates the current total amount Vt as a value equal to the ink amount Vs (Vt=Vsc) (S37). As the ink amount Vc becomes zero, the total amount Vt has the same value as the ink amount Vs.

Then, the controller 130 displays either one of both the current ink amount Vc and the ink amount Vs and the current total amount Vt on the display 17. In addition, the controller 130 overwrites the ink amount Vc stored in the memory of the IC substrate 247 of the cartridge 200 with the above-described ink amount Vc (=0) (S39). Information of the ink amount Vc (Vc=0) stored in the memory of the IC substrate 247 is an example of already used information.

Since the change in the output of the liquid level sensors 155 is in the middle of the process of S21, the predetermined ink amount Vsc read in step S 37 is not strictly the amount of ink stored in the tank 160 at the moment the output of the liquid level sensor 155 changes, but indicates the amount of ink immediately before the output of the liquid level sensor 155 changes. However, since the difference in the ink amount is small, the ink amount Vsc read in step S37 is approximately treated as the ink amount Vs at the time when the output of the liquid level sensor 155 changes.

In addition, the controller 130 counts up the count value SN stored in EEPROM 134 with the value corresponding to the amount of ink instructed to be discharged in the immediately previous step S21 (S40). In other words, the controller 130 starts to update the count value SN in response to the change from the low-level signal into the high-level signal in the output of the liquid level sensors 155. The controller 130 counts up the count value TN stored in the EEPROM 134 with a value corresponding to the amount of ink instructed to be discharged in the immediately previous step S21.

Then, the controller 130 calculates the ink amount Vs (S41). The calculated ink amount Vs is a value obtained by subtracting from the ink amount corresponding to the count value SN stored in the EEPROM 134 from the predetermined ink amount Vsc stored in the ROM 132. As described above, after the output of the liquid level sensor 155 becomes the high-level signal, the ink amount Vs is the same value as the current total amount Vt. In addition, the ink amount Vc is zero.

The controller 130 determines the ink amount Vc and the ink amount Vs based on the total ink amount Vt obtained by subtracting the count value SN. Then, the controller 130 displays either one of both the calculated current ink amount Vc and the ink amount Vs and the calculated current total amount Vt on display 17 (S42). Since the ink amount Vc is zero after the output of liquid level sensor 155 becomes the high-level signal, the controller 130 does not need to update the ink amount Vc stored in the memory of the IC substrate 247 of the cartridge 200.

Next, the controller 130 compares the count value SN updated in step S40 with the threshold value $N_{th}$ (S43). When it is determined that the count value SN updated in step S40 is smaller than the threshold value $N_{th}$ (S43: No), the controller 130 ends counting process. On the other hand, when it is determined that the count value SN updated in step S40 is equal to or more than the threshold value $N_{th}$ (S43: Yes), the controller 130 puts "ON" into the S_Empty flag (S44). Then, the controller 130 prohibits the discharge of the ink through the head 21 and completes the counting process when the S_Empty flag is set to "ON".

Furthermore, the controller 130 reads the count value SN stored in the EEPROM 134 in response to the fact (S31: H→H) that both information stored in the RAM 133 in steps S20 and S22 indicates the high-level signal. Then, the controller 130 counts up the read count value SN with a value corresponding to the amount of ink instructed to be discharged in the immediately previous step S21 and stores the value in the EEPROM 134 again. That is, the controller 130 updates the count value SN (S40). The controller 130 also updates the count value TN. Next, the controller 130 executes the process from step S41 to step S44 described above using the count value SN updated in step S40.

According to the embodiment, the ink amounts Vc and Vs can be obtained from the current total amount Vt using the functions F1 and F2. Further, the total amount Vt is updated to the predetermined ink amount Vsc when the liquid level sensor 155 outputs the high-level signal, and the total amount Vt can be corrected. Then, the ink amounts Vc and Vs can be determined from the corrected total amount Vt. In addition, it is possible to determine the timing at which ink is no longer supplied from the liquid chamber 210 of the cartridge 200 to the liquid chamber 171 of the tank 160 and the subsequent ink amount Vs.

In addition, since the controller 130 displays the C_Empty notification screen indicating that the cartridge needs to be replaced, on the display 17, it is possible to notify the user that the cartridge 200 needs to be replaced.

Further, since the ink amount Vc is stored in the memory of the IC substrate 247, even when the cartridge 200, in which the ink is consumed, is taken out from the installation case 150, the ink amount Vc of the liquid chamber 210 of the taken-out cartridge 200 can be read from the IC substrate 247. Then, when the cartridge 200, in which the ink is consumed, is installed in the installation case 150, the ink amount Vc is read from the IC substrate 247 and the total amount Vt is calculated.

In addition, since the memory of the IC substrate 247 stores ink amount Vc=0), it can be determined that the cartridge 200 does not contain the ink.

(Modification to Exemplary Embodiments)

Figure 10B:
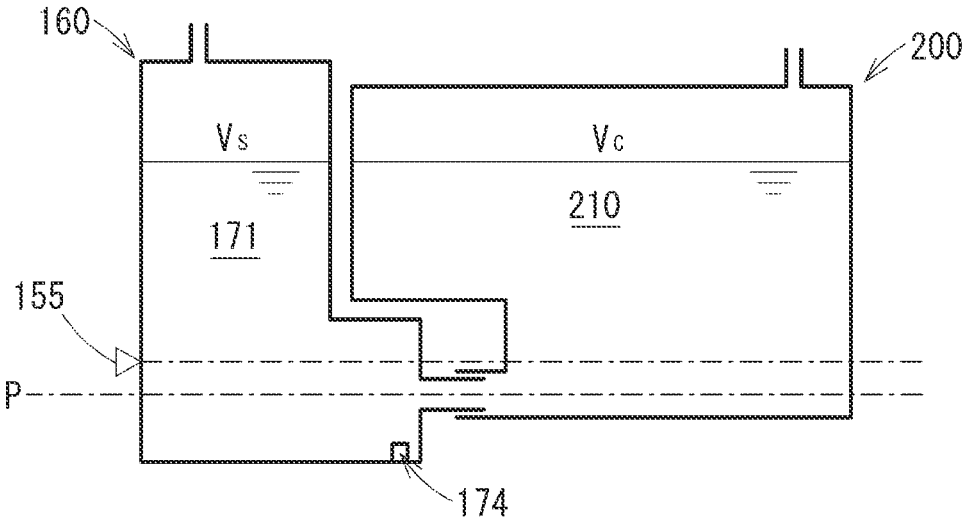
FIG. 10B is a schematic view illustrating a state where a cartridge communicates with a tank and illustrates a detection position of a liquid level sensor according to a second modification.

In the embodiment described above, the controller 130 detects the liquid level of the ink at the predetermined position P of the liquid chamber 171, based on the signal output from the liquid level sensor 155. Alternatively, as illustrated in FIG. 10B, above the predetermined position P, the controller 130 may detect the liquid level of the ink at a position below the liquid level when the initial ink amount Vc0 is stored in the liquid chamber 210, based on the signal output from the liquid level sensor 155.

When the controller 130 detects, based on the signal output from the liquid level sensor 155, the liquid level of the ink at the position above the predetermined position P, the ink is stored in the liquid chamber 210 of the cartridge 200, and the ink is also stored in the liquid chamber 171 of the tank 160. In the counting process described above, the controller 130 starts to update the count value SN without executing steps S36 to S39 (S40). Then, as in steps S32 to S35, the ink amounts Vc and Vs are calculated from the current total amount Vt, and stores the ink amount Vc in the memory of the IC substrate 247.

The controller 130 may display the screen notifying that the C_Empty is close (near empty) on the display 17 in response to determining that the signal received from the liquid level sensor 155 changes from the low-level signal to the high-level signal. Thus, it is possible to notify the user that the ink stored in the liquid chamber 210 of the cartridge 200 is nearly used up.

Then, the controller 130 executes steps S36 to S39 when the count value SN reaches a threshold Np. The threshold Np corresponds to an ink amount required for the liquid level of the liquid chamber 171 of the tank 160 to reach the predetermined position P after the controller 130 detects the liquid level of the predetermined position P based on the signal output from the liquid level sensor 155. Thereafter, steps S41 to S44 are executed based on the updated count value SN (S40).

(Other Modifications)

In the embodiment described above, the controller 130 sets the C_Empty flag to "ON" at the timing when determining that the signal of the liquid level sensor 155 changes from the low-level signal to the high-level signal, but the timing may be changed. For example, the controller 130 may set the C_Empty flag to "ON" at the timing when the updated count value SN reaches the predetermined threshold after determining that the signal of the liquid level sensor 155 changes from the low-level signal to the high-level signal. That is, the controller 130 may set the C_Empty flag to "ON" until the ink amount Vs becomes zero form when the ink amount Vc becomes zero, and may the C_Empty notification screen on the display 17.

In the embodiment described above, the ink amount Vs is calculated from the current total amount Vt using the functions F1 and F2, but the disclosure is not limited thereto. For example, the ink amount Vc is calculated from the current total amount Vt using a function indicating approximately the relation between the current total amount Vt and the ink amount Vc, and the calculated ink amount Vc is subtracted from the current total amount Vt, whereby the ink amount Vs may be calculated.

In the embodiment described above, the functions F1 and F2 are stored in the EEPROM 134, but the functions F1 and F2 may be stored in the memory of the IC substrate 247 of the cartridge 200. In addition, the controller 130 may read type information and the functions F1 and F2 from the IC substrate 247 of the cartridge 200 installed in the installation case 150, and may set the read functions F1 and F2 as functions F1 and F2 corresponding to the cartridge 200. Further, in place of the functions F1 and F2, a table indicating correlation between the current total amount Vt, the ink amount Vc, and the ink amount Vs may be stored in the IC substrate 247 or the EEPROM 134. Then, when the current total amount Vt can be specified, the ink amount Vc and the ink amount Vs are determined from the table.

In the embodiment described above, the controller 130 stores the total amount Vt after the exchange of the cartridge 200 in the EEPROM 134, subtracts the ink amount corresponding to the count value TN from the total amount Vt, and obtains the current total amount Vt, but the disclosure is not limited thereto. For example, the controller 130 may update the total amount Vt every time the ink is discharged through the head 21, and may store it in the EEPROM 134. When the ink is discharged through the next head 21, the controller 130 may calculate the amount of the ink to be discharged based on the count value TN, and ay update the total amount Vt by subtracting from the total amount Vt stored in the EEPROM 134.

In the embodiment described above, the controller 130 detects, based on the signal output from the liquid level sensor 155, whether the detection target portion 194 of the actuator 190 is located at the detection position. However, the configuration of the liquid level sensor 155 is not particularly limited as long as the liquid level of the ink in the liquid chamber 171 can be detected. For example, the liquid level sensor 155 may be a sensor for optically detecting the liquid level of the ink in the liquid chamber 171 using a prism having a different reflectance depending on whether the ink is in contact with the rear wall 164 (an example of a detection object) of the liquid chamber 171. Further, the liquid level of the ink in the liquid chamber 171 may be detected by electrodes. In addition, the liquid level sensor 155 may output different signals depending on the liquid level of the liquid chamber 210 of the cartridge 200 instead of outputting different signals depending on the liquid level of the liquid chamber 171 of the tank 160.

In the embodiment described above, the controller 130 executes step S15 in response to obtaining the low-level signal from the installation sensor 154, obtaining the high-level signal from the installation sensor 154, and obtaining the low-level signal from the installation sensor 154 (S14: Yes). The controller 130 executes step S15 when the cartridge 200 is installed in the installation case 150 in which the cartridge 200 does not exist. That is, the controller 130 may execute step S15 in response to determining that the cartridge 200 is installed in the installation case 150. As an example, the controller 130 obtains the low-level signal from the installation sensor 154, obtains the high-level signal from the installation sensor 154, and then obtains the low-level signal from the installation sensor 154 when the controller 130 determines that the cartridge is installed in the installation case 150. Another example in which the controller 130 is installed in the installation case 150 will be described below.

For example, the controller 130 receives the low-level signal after receiving the high-level signal from the cover sensor 88. Then, the controller 130 reads the identification information from the memory of the IC substrate 247 and compares the read identification information with the identification information of the cartridge 200 before exchange stored in the EEPROM 134. When it is determined that the identification information read from the memory of the IC substrate 247 and the identification information stored in the EEPROM 134 are different from each other, the controller 130 may execute the process illustrated in step S15. That is, "the controller 130 reads identification information from the memory of the IC substrate 247 and compares the read identification information with the identification information of the cartridge 200 before exchange stored in the EEPROM 134. As a result, it is determined that the identification information read from the memory of the IC substrate 247 and the identification information stored in the EEPROM 134 are different from each other" is an example in which the controller 130 determines that the cartridge 200 is installed in the installation case 150.

For example, the controller 130 receives the low-level signal after receiving the high-level signal from the cover sensor 88. Then, the controller 130 causes the user to display a confirmation screen indicating whether or not a new cartridge 200 is installed in the installation case 150 through the display 17. The controller 130 receives an input corresponding to the confirmation screen through the operation panel 22 while the confirmation screen is being displayed on the display 17. The controller 130 executes the process illustrated in step S15 when the received input corresponds to the installation of a new cartridge 200 in the installation case 150. That is, "the controller 130 receives the low-level signal after receiving the high-level signal from the cover sensor 88. Then, the controller 130 causes the user to display a confirmation screen indicating whether or not a new cartridge 200 is installed in the installation case 150 through the display 17. The controller 130 receives an input corresponding to the confirmation screen through the operation panel 22 while the confirmation screen is being displayed on the display 17. The received input corresponds to the installation of a new cartridge 200 in the installation case 150" is an example in which the controller 130 determines that the cartridge 200 is installed in the installation case 150.

In the embodiment described above, the controller 130 prohibits the ink from being discharged through the head 21 when the S_Empty flag is "ON". However, the discharge of ink through the head 21 is not necessarily prohibited and the controller 130 may only display the S_Empty notification screen on the display 17 when the S_Empty flag is "ON".

In addition, the IC substrate 247 is electrically connectable with the contact with the contact 152. However, an information medium and an interface for reading and writing data in a contactless manner using radio waves such as near field communication (NFC) or radio frequency identification (RFID) may be adopted.

Furthermore, in the embodiment described above, the ink is an example of liquid. However, the liquid, for example, may be pretreatment liquid discharged to a paper and the like prior to ink at the time of image recording, or may be water for cleaning the head 21.

As discussed above, the disclosure may provide at least the following illustrative, non-limiting embodiments.

(1) A liquid discharge device comprising: an installation case configured to receive a cartridge, the cartridge comprising: a first liquid chamber storing a liquid; a first flow path, one end of the first flow path communicated with the first liquid chamber, the other end of the first flow path communicated with the outside; and a second flow path, in which one end of the second flow path communicated with the first liquid chamber, the other end of the second flow path communicated with the outside; a tank comprising: a second liquid chamber; a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber; a fourth flow path, one end of the fourth flow path below the third flow path and communicated with the second liquid chamber; and a fifth flow path, one end of the fifth flow path communicated with the second liquid chamber, the other end of the fifth flow path communicated with the outside; a head communicated with the other end of the fourth flow path; a liquid level sensor; a memory; and a controller configured to: receive a first discharge instruction to discharge a liquid through the head; update a first count value with a value equivalent to an amount of the liquid instructed to be discharged by the first discharge instruction; subtract the first count value from a total liquid amount Vt, which is a sum of a liquid amount Vc stored in the first liquid chamber and a liquid amount Vs stored in the second liquid chamber, so as to determine the total liquid amount Vt; determine the liquid amount Vc and the liquid amount Vs based on the determined total liquid amount Vt; receive, from the liquid level sensor, a first signal in a case a position of a liquid level in the second liquid chamber is equal to or higher than a predetermined position; based on receiving, from the liquid level sensor, a second signal after receiving the first signal, determine the liquid amount Vt as a fixed value A, the second signal being received from the liquid level sensor in a case the position of the liquid level in the second liquid chamber is lower than the predetermined position; receive a second discharge instruction to discharge a liquid through the head, the second discharge instruction received after the receiving of the second signal from the liquid level sensor after receiving the first signal; on a condition that the second discharge instruction is received, update a second count value with a value equivalent to an amount of the liquid instructed to be discharged by the second discharge instruction; subtract the second count value from the total liquid amount Vt determined as the fixed value A so as to calculate the total liquid amount Vt; and determine the liquid amount Vc and the liquid amount Vs based on the total liquid amount Vt obtained by subtracting the second count value.

According to the above configuration, the liquid amount Vc of the first liquid chamber and the liquid amount Vs of the second liquid chamber can be obtained from the total liquid amount Vt. In addition, the total liquid amount Vt can be determined as the fixed value A when the liquid level sensor outputs the second signal and the total liquid amount Vt can be corrected. Then, the liquid amount Vc and the liquid amount Vs can be determined from the corrected total liquid amount Vt.

(2) Preferably, the controller is configured to: based on receiving the second signal from the liquid level sensor after receiving the first signal, update the liquid amount Vc stored in the memory to zero and update the liquid amount Vs to the total liquid amount Vt.

According to the above configuration, it is possible to determine the liquid amount Vs after the liquid is no longer supplied from the first liquid chamber to the second liquid chamber.

(3) Preferably, the predetermined position is equal to or lower than an imaginary line extending a horizontal direction through the flow path formed by the first flow path and the third flow path, in a state where the cartridge is installed in the installation case.

According to the above configuration, it is possible to determine the timing at which ink is no longer supplied from the first liquid chamber to the second liquid chamber and the subsequent ink amount Vs.

(4) Preferably, the tank comprises a detection object, the detection object being in a first state when the position of the liquid level in the second liquid chamber is equal to or higher than the predetermined position, the detection object being in a second state when the position of the liquid level in the second liquid chamber is lower than the predetermined position, the second state being different from the first state, and the liquid level sensor is configured to: transmit the first signal based on detecting the detection object being in the first state; and transmit the second signal based on detecting the detection object being in the second state.

According to the above configuration, it is possible to accurately determine the liquid amount Vs after the liquid is no longer supplied from the first liquid chamber to the second liquid chamber.

(5) Preferably, the liquid discharge device further comprises a notification device, and the controller is configured to operate the notification device until the liquid amount Vs becomes zero from when the liquid amount Vc becomes zero.

According to the above configuration, it is possible to notify the user of the necessity of cartridge exchange.

(6) Preferably, the predetermined position is located above an imaginary line extending a horizontal direction through the flow path formed by the first flow path and the third flow path, in a state where the cartridge is installed in the installation case, and the predetermined position is located below the liquid level of the liquid initially stored in the first liquid chamber, and the controller is configured to set the liquid amount Vs to the total liquid amount Vt on a condition that the liquid amount Vc stored in the memory becomes zero.

According to the above configuration, it is possible to determine the liquid amount Vs after the liquid is no longer supplied from the first liquid chamber to the second liquid chamber.

(7) Preferably, the liquid discharge device further comprises a notification device, and the controller is configured to operate the notification device based on at least one of the determined liquid amounts Vc, Vs and Vt.

(8) Preferably, the liquid discharge device further comprises a notification device, and the controller is configured to operate the notification device based on receiving the second signal from the liquid level sensor after receiving the first signal.

According to the above configuration, it is possible to notify the user that exchange timing of the cartridge is approaching.

(9) Preferably, the controller is configured to operate the notification device when the liquid amount Vc is zero.

According to the above configuration, it is possible to notify the user of the necessity of cartridge exchange.

(10) Preferably, the liquid discharge device further comprises an interface, and the controller is configured to store the determined liquid amount Vc in a cartridge memory of the cartridge through the interface.

According to the above configuration, the liquid amount Vc of the first liquid chamber of the cartridge can be read from the cartridge memory even when the cartridge, in which the liquid is consumed, is taken out from the installation case.

(11) Preferably, the controller is configured to: determine whether the cartridge is installed in the installation case; based on determining that the cartridge is installed in the installation case, read the liquid amount Vc stored in the cartridge memory; calculate the total liquid amount Vt based on the liquid amount Vc read from the cartridge memory and the liquid amount Vs stored in the memory before determining that the cartridge is installed; and store the calculated total liquid amount Vt in the memory.

According to the above configuration, the liquid amount Vc of the first liquid chamber of the cartridge can be read from the cartridge memory even when the cartridge, in which the liquid is consumed, is taken out from the installation case, and the total liquid amount Vt can be calculated.

(12) Preferably, the controller is configured to store the already used information in the cartridge memory through the interface when liquid amount Vc becomes zero.

According to the above configuration, it is possible to determine that the cartridge does not contain the liquid, based on the already used information of the cartridge memory.

(13) Preferably, the memory stores an arithmetic expression, and the controller is configured to calculate at least one of the liquid amount Vc and the liquid amount Vs from the total liquid amount Vt and the arithmetic expression.

According to the above configuration, the liquid amount Vc of the first liquid chamber or the liquid amount Vs of the second liquid chamber can be calculated from the total liquid amount Vt, using the arithmetic expression.

According to the disclosure, it is possible to individually grasp the amount of ink stored in each of the first liquid chamber and the second liquid chamber.

What is claimed is:

1. A liquid discharge device comprising:

an installation case configured to receive a cartridge, the cartridge comprising:

a first liquid chamber storing a liquid;

a first flow path, one end of the first flow path communicated with the first liquid chamber, the other end of the first flow path communicated with an outside of the cartridge; and a second flow path, in which one end of the second flow path communicated with the first liquid chamber, the other end of the second flow path communicated with the outside;

a tank comprising:

a second liquid chamber;

a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber;

a fourth flow path, one end of the fourth flow path below the third flow path and communicated with the second liquid chamber; and a fifth flow path, one end of the fifth flow path communicated with the second liquid chamber, the other end of the fifth flow path communicated with the outside of the cartridge;

a head communicated with the other end of the fourth flow path;

a liquid level sensor;

a memory; and a controller configured to:

receive a first discharge instruction to discharge a liquid through the head;

update a first count value with a value equivalent to an amount of the liquid instructed to be discharged by the first discharge instruction;

subtract the first count value from a total liquid amount Vt, which is a sum of a liquid amount Vc stored in the first liquid chamber and a liquid amount Vs stored in the second liquid chamber, so as to determine the total liquid amount Vt;

determine the liquid amount Vc and the liquid amount Vs based on the determined total liquid amount Vt;

receive, from the liquid level sensor, a first signal in a case a position of a liquid level in the second liquid chamber is equal to or higher than a predetermined position;

based on receiving, from the liquid level sensor, a second signal after receiving the first signal, determine the liquid amount Vt as a fixed value A, the second signal being received from the liquid level sensor in a case the position of the liquid level in the second liquid chamber is lower than the predetermined position;

receive a second discharge instruction to discharge a liquid through the head, the second discharge instruction received after the receiving of the second signal from the liquid level sensor after receiving the first signal;

on a condition that the second discharge instruction is received, update a second count value with a value equivalent to an amount of the liquid instructed to be discharged by the second discharge instruction;

subtract the second count value from the total liquid amount Vt determined as the fixed value A so as to calculate the total liquid amount Vt; and determine the liquid amount Vc and the liquid amount Vs based on the total liquid amount Vt obtained by subtracting the second count value.

2. The liquid discharge device according to claim 1, wherein the controller is configured to:

based on receiving the second signal from the liquid level sensor after receiving the first signal, update the liquid amount Vc stored in the memory to zero and update the liquid amount Vs to the total liquid amount Vt.

3. The liquid discharge device according to claim 2, wherein the predetermined position is equal to or lower than an imaginary line extending a horizontal direction through the flow path formed by the first flow path and the third flow path in a state where the cartridge is installed in the installation case.

4. The liquid discharge device according to claim 3, wherein the tank comprises a detection object, the detection object being in a first state when the position of the liquid level in the second liquid chamber is equal to or higher than the predetermined position, the detection object being in a second state when the position of the liquid level in the second liquid chamber is lower than the predetermined position, the second state being different from the first state, and wherein the liquid level sensor is configured to:

transmit the first signal based on detecting the detection object being in the first state; and transmit the second signal based on detecting the detection object being in the second state.

5. The liquid discharge device according to claim 1, further comprising:

a notification device, wherein the controller is configured to operate the notification device based on at least one of the determined liquid amounts Vc, Vs and Vt.

6. The liquid discharge device according to claim 1, further comprising:

a notification device, wherein the controller is configured to operate the notification device until the liquid amount Vs becomes zero from when the liquid amount Vc becomes zero.

7. The liquid discharge device according to claim 1, wherein the predetermined position is located above an imaginary line extending a horizontal direction through the flow path formed by the first flow path and the third flow path in a state where the cartridge is installed in the installation case, and the predetermined position is located below the liquid level of the liquid initially stored in the first liquid chamber, and wherein the controller is configured to set the liquid amount Vs to the total liquid amount Vt on a condition that the liquid amount Vc stored in the memory becomes zero.

8. The liquid discharge device according to claim 7, further comprising:

a notification device, wherein the controller is configured to operate the notification device based on receiving the second signal from the liquid level sensor after receiving the first signal.

9. The liquid discharge device according to claim 8, wherein the controller is configured to operate the notification device in the case the liquid amount Vc is zero.

10. The liquid discharge device according to claim 1, further comprising:

an interface, wherein the controller is configured to store the determined liquid amount Vc in a cartridge memory of the cartridge through the interface.

11. The liquid discharge device according to claim 10, wherein the controller is configured to:

determine whether the cartridge is installed in the installation case;

based on determining that the cartridge is installed in the installation case, read the liquid amount Vc stored in the cartridge memory;

calculate the total liquid amount Vt based on the liquid amount Vc read from the cartridge memory and the liquid amount Vs stored in the memory before determining that the cartridge is installed; and store the calculated total liquid amount Vt in the memory.

12. The liquid discharge device according to claim 10, wherein the controller is configured to store the already used information in the cartridge memory through the interface in a case liquid amount Vc becomes zero.

13. The liquid discharge device according to claim 1, wherein the memory stores an arithmetic expression, and wherein the controller is configured to calculate at least one of the liquid amount Vc and the liquid amount Vs from the total liquid amount Vt and the arithmetic expression.

* * * * *